US006925190B2

(12) United States Patent
Popken et al.

(10) Patent No.: US 6,925,190 B2
(45) Date of Patent: Aug. 2, 2005

(54) FLUSH MOUNT SPEAKER MOUNTING APPARATUS

(75) Inventors: Ian Popken, Newburyport, MA (US); Andy Lewis, Lee, NH (US); Allen Boothroyd, Cambridge (GB); Tim Evans, Cambridge (GB)

(73) Assignee: Russound/FMP, Inc., Newmarket, NH (US)

( * ) Notice: Subject to any disclaimer, the term of this patent is extended or adjusted under 35 U.S.C. 154(b) by 118 days.

(21) Appl. No.: 10/238,824

(22) Filed: Sep. 10, 2002

(65) Prior Publication Data

US 2004/0047487 A1 Mar. 11, 2004

(51) Int. Cl.[7] ..... H04R 25/00

(52) U.S. Cl. ..... 381/395; 381/335; 381/186; 381/386

(58) Field of Search ..... 381/395, 332, 381/87, 86, 333, 388–389, 182, 386; 181/144–145, 147

(56) References Cited

U.S. PATENT DOCUMENTS

| | | | | | |
|---|---|---|---|---|---|
| 4,502,149 | A | * | 2/1985 | Gefvert | 381/182 |
| 4,577,069 | A | * | 3/1986 | Keezer | 381/420 |
| 4,853,966 | A | * | 8/1989 | Skrzycki | 381/395 |
| 5,315,663 | A | * | 5/1994 | Thiele | 381/388 |
| 5,331,119 | A | | 7/1994 | Leger et al. | 181/160 |
| 5,400,407 | A | | 3/1995 | Cassity et al. | 381/87 |
| 5,414,229 | A | * | 5/1995 | Rocheleau et al. | 181/150 |
| 5,734,732 | A | * | 3/1998 | Lemmon | 381/386 |
| D419,561 | S | | 1/2000 | Haase et al. | D14/216 |
| 6,070,694 | A | | 6/2000 | Burdett et al. | 181/150 |
| 6,101,262 | A | * | 8/2000 | Haase et al. | 381/386 |
| 6,683,963 | B2 | * | 1/2004 | Sterns et al. | 381/182 |
| 6,694,036 | B2 | * | 2/2004 | Makino | 381/389 |

* cited by examiner

*Primary Examiner*—Curtis Kuntz
*Assistant Examiner*—Phylesha Dabney
(74) *Attorney, Agent, or Firm*—Weingarten, Schurgin, Gagnebin & Lebovici LLP

(57) ABSTRACT

Loudspeaker mounting apparatus that permits mounting of a loudspeaker at an angle to a mounting surface. In one embodiment the apparatus comprises an assembly that includes a frame member that is flush mountable in a cutout in the mounting surface. The frame member includes an angled flange that is employed for the mounting of a cooperative baffle. The front of the baffle is recessed behind the mounting surface to permit a flush speaker installation. The baffle mounts to the angled flange of the frame member in one of two possible predetermined orientiations so as to disperse sound around a centerline that is either oriented normal to the mounting surface or at a predetermined angle from normal corresponding to the degree of angle incorporated into the frame and baffle assembly. In an alternative embodiment, a single panel-mount loudspeaker mounting frame is provided that has a speaker mounting surface angled with respect to the mounting surface so as to disperse sound around a centerline angled with respect to the plane of the wall or ceiling in which it is mounted. The speaker mounting surface is recessed within the wall when the the frame member is mounted in its intended mounting position so that the speaker will not extend into the room when the frame member is mounted to the wall or ceiling.

20 Claims, 9 Drawing Sheets

FLUSH MOUNT SPEAKER MOUNTING APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention pertains to wall and ceiling mounted speakers and more specifically to a mounting frame for mounting a speaker in a wall or ceiling.

The architectural or custom installed loudspeaker industry continues to gain popularity each year. The shortcomings of standard recessed, flush-mount loudspeaker products have likewise become more generally known. More specifically, sound radiation from conventional flush mounted loudspeakers is often far from ideal due to limitations regarding the location of speakers within a room and the listening position.

Problems arise when the listener moves away from the axis of radiation of a speaker. The directivity of the radiating sound is related to the size and shape of the individual transducers that make up the loudspeaker array. Generally, sound dispersion can be described in terms of the ratio of the size of the radiating source to the wavelength of the radiated sound. When the source circumference is small compared to the emitted wavelength, the dispersion can be thought of as mostly hemispherical or wide. Likewise, as the ratio of source circumference to emitted wavelength increases, the dispersion of sound begins to narrow. Two-way transducers are often employed that include a cone type transducer for low and/or mid-range sound reproduction and another transducer, such as a dome type transducer for higher frequency sound reproduction. Midrange frequencies in the 1.5 to 3 kHz range have much wider radiation patterns coming from a 1" dome type transducer than they do from say an 8" cone type transducer. For a given two-way transducer array as described, when a listener is even modestly off-axis, midrange information loss can be apparent and continues to worsen as the degree of off-axis listening increases. This is a significant issue since midrange information contains essential vocal and musical material while also being a sensitive frequency band to the human ear.

Practical room, installation, and aesthetic considerations further complicate the situation. Optimal speaker placement is often prevented as a consequence of room parameters including the location of windows, doors and furniture. Also, the desire for an unobtrusive loudspeaker installation is the increasing trend. Being able to point the sound radiation in something other than a forward manner without protruding into the room environment becomes a clear advantage.

Previous attempts have been made to provide adjustable loudspeaker assemblies with one or more rotating, pivoting, or swiveling assemblies in an attempt to direct sound for optimal listening. These assemblies tend to be expensive to produce.

The '407 patent describes a tilt-adjusting wedge adapter that can be added to an existing frame assembly to set the baffle forward of the mounting surface, thereby offering sound directivity.

Numerous patents describe pivoting, swiveling, rotating, or otherwise adjustable driver or driver array assemblies, mounted either proud or flush, that require adjustment of one or more assemblies in an effort to achieve the desired directivity, have been established.

In view of the foregoing, there is a need for an improved method of directing sound radiation by integrating the directional capability into the frame and baffle of a flush panel-mount loudspeaker system.

BRIEF SUMMARY OF THE INVENTION

In accordance with the present invention a novel angled frame member for the mounting of a loudspeaker is disclosed. The frame member allows the loudspeaker to be mounted at a predetermined angle from the mounting surface. A multi-piece frame member and baffle assembly allows the speaker to be mounted in one of two orientations to allow for the installer to select the desired angle of sound dispersion.

The multi-piece frame assembly including a frame member and baffle provides first and second mounting orientations for a loudspeaker. In the first orientation, the loudspeaker is mounted in a plane parallel to the mounting surface so that the loudspeaker disperses sound generally around a centerline normal to the mounting surface. In the second orientation, the loudspeaker is angled at a predetermined angle with respect to the mounting surface so as to disperse sound generally around a centerline angled with respect to the mounting surface. The frame assembly provides for recessed mounting of the loudspeaker to provide a substantially flush and unobtrusive mounting assembly.

In an alternative embodiment a single piece frame member is employed that allows for the mounting of a loudspeaker at an angle to the mounting surface.

The perimeter of the frame member may be square, rectangular, circular, trapezoidal, or any other suitable shape.

Other features, aspects and advantages of the present invention will be apparent from the following Detailed Description of the Invention.

BRIEF DESCRIPTION OF THE SEVERAL VIEWS OF THE DRAWING

The invention will be more fully understood by reference to the following Detailed Description of the Invention in conjunction with the following Drawing of which.

DETAILED DESCRIPTION OF THE INVENTION

In accordance with the present invention a system and method for mounting a loudspeaker behind a mounting surface such as a wall or ceiling is disclosed. In the disclosed system the loudspeaker may be either oriented to direct sound around a centerline normal to a plane defined by the mounting surface or along a centerline oriented at a predetermined angle to the plane of the mounting surface.

Figure 1:
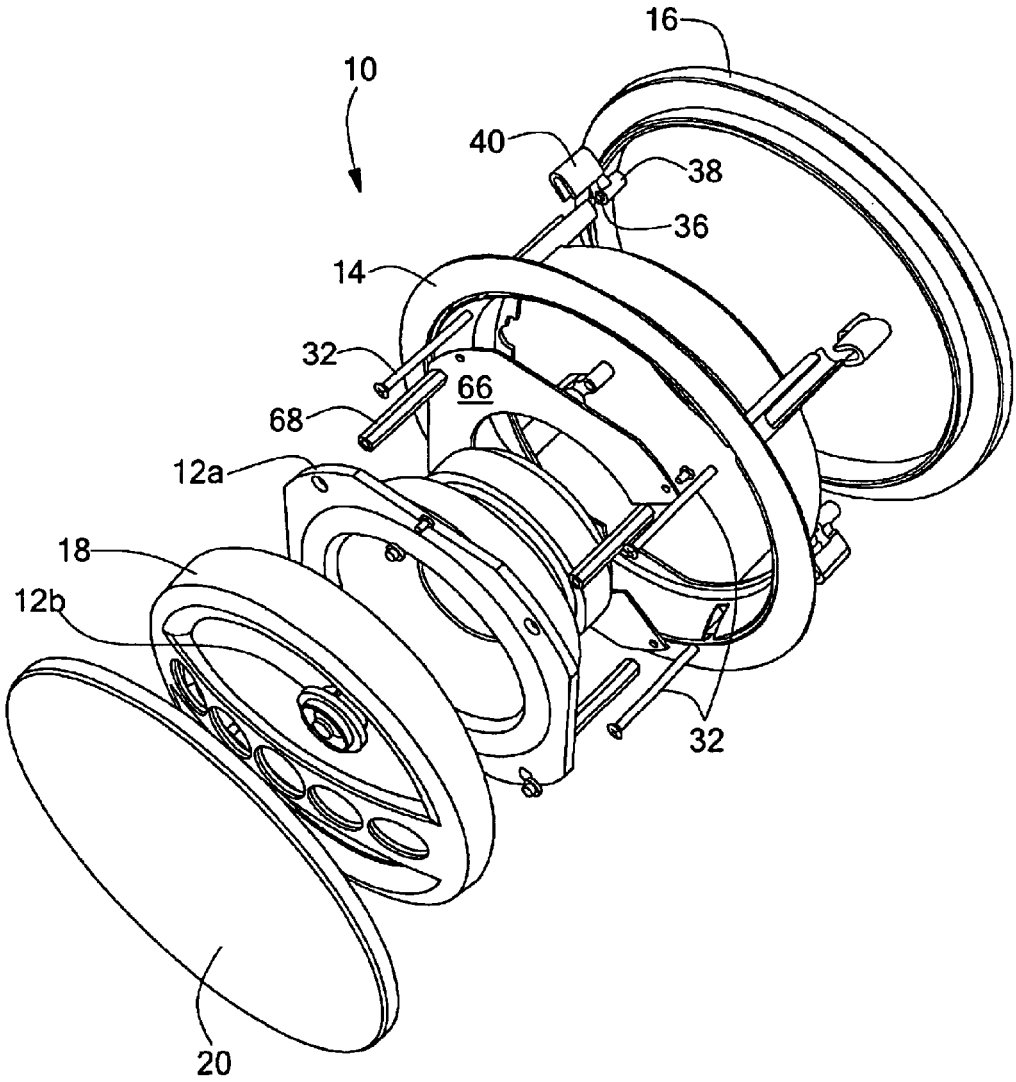
FIG. 1 is an exploded perspective assembly depicting the components employed in a mounting system in accordance with the present invention.

Referring to FIG. 1, an assembly 10 for mounting speakers 12*a*, 12*b* is shown. The assembly 10 includes a frame member 14, a retaining ring 16, a baffle 18 and a perf grill 20.

Figure 2A:
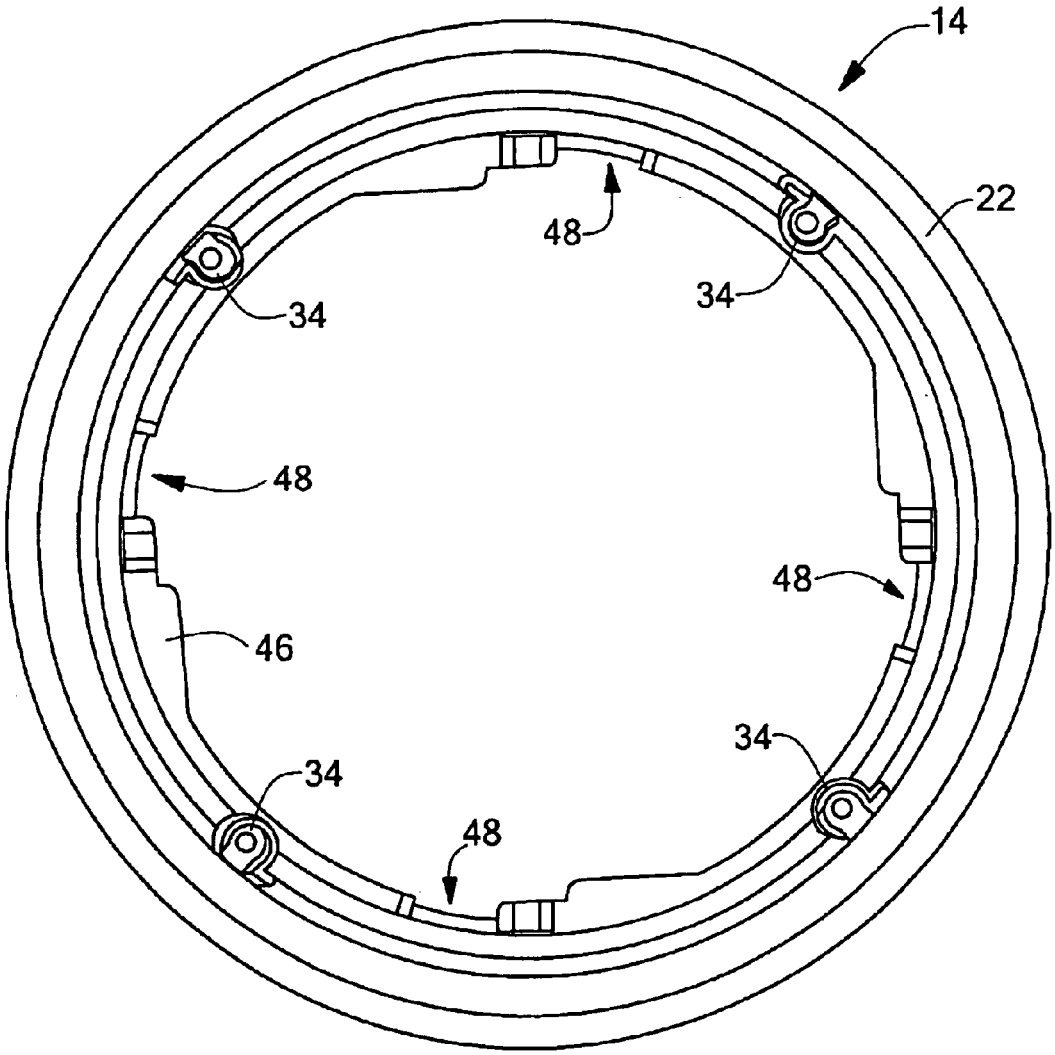
FIG. 2*a* is a front view of a frame member of the type depicted in FIG. 1.
Figure 2B:
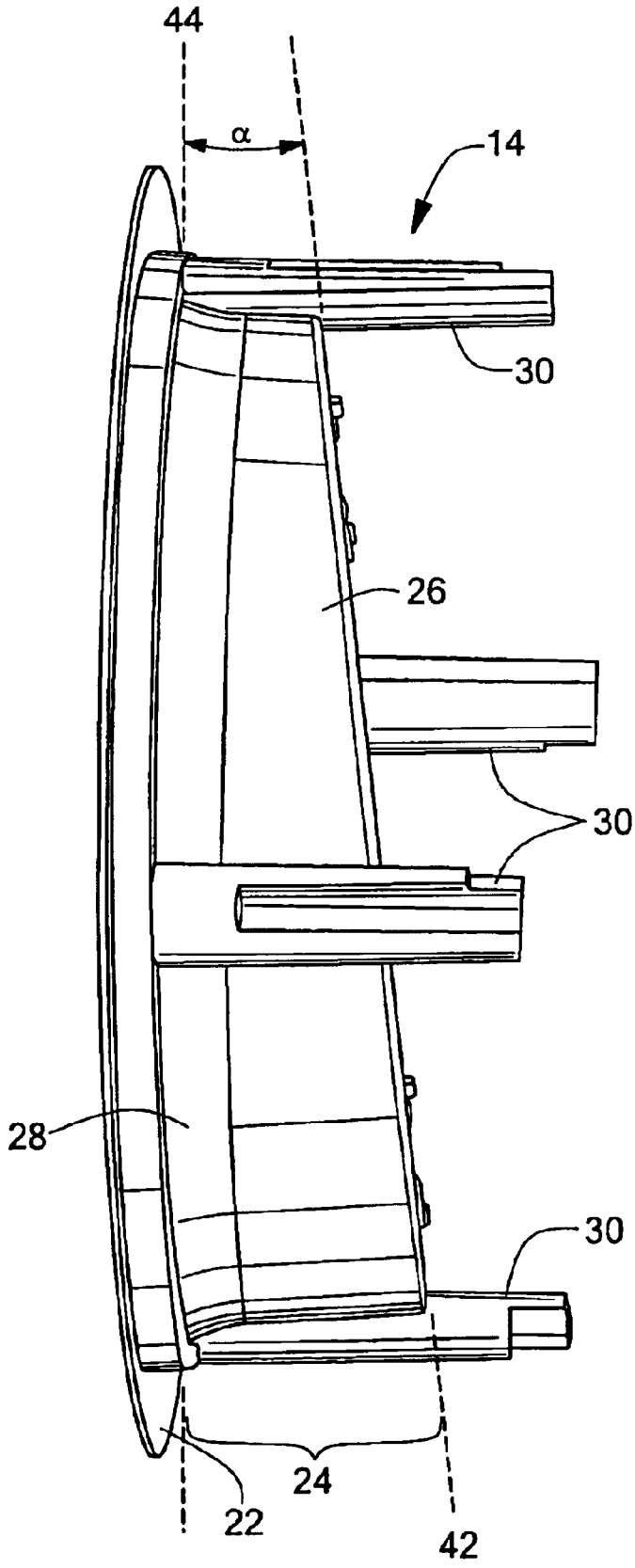
FIG. 2*b* is a side view of a frame member of the type depicted in FIG. 1.
Figure 2C:
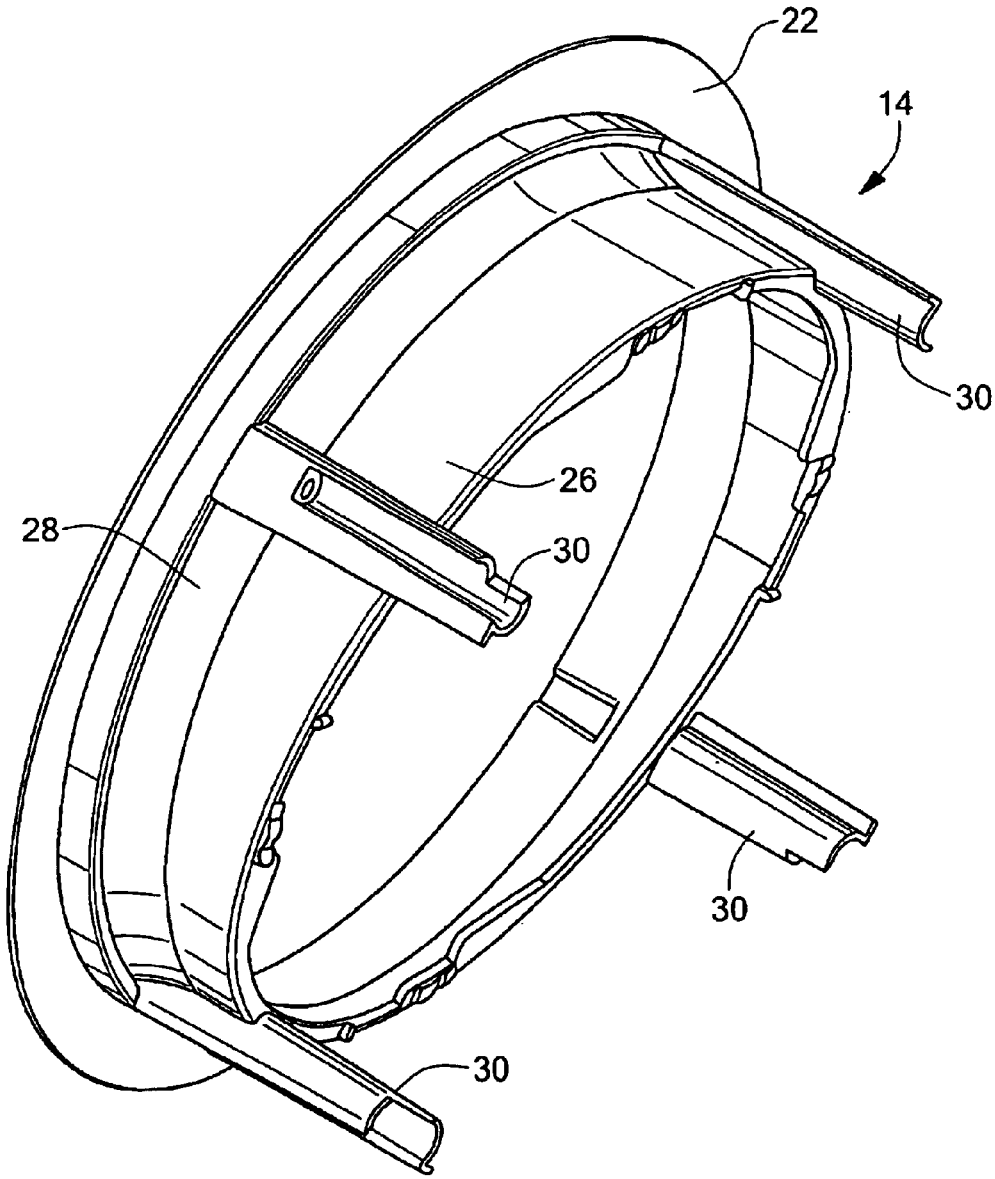
FIG. 2*c* is a perspective view of the frame member depicted in FIG. 2*a;*

The frame member 14 is depicted with greater particularity in FIGS. 2*a*–2*c*. More specifically, the frame member 14 in the embodiment depicted herein is generally circular and includes a lip 22 at the periphery of the frame member 14. The lip 22 is intended to abut the mounting surface when the frame 14 is disposed in a mounting position with respect to the mounting surface. The frame member 14 includes a body portion 24 that includes a truncated cylinder 26. The body portion is coupled to the lip 22 via a transition region 28. The frame member 14 further includes channels 30 through which clamp screws 32 (FIG. 1) may pass for the purpose of securing the frame member 14 to the mounting surface. More specifically, the clamp screws 32 (FIG. 1) pass through openings 34 in the frame member 14 (FIG. 2*a*) and through the channels 30 (FIG. 2*c*). The clamp screws 32 are threaded into threaded openings 36 in the mounting portions 38 of respective clamp members 40. The retaining ring 16 is located in a mounting position with respect to a circular opening in and behind the mounting surface. The clamp members 40 are oriented such that the rotation of the clamp screw 32 cause the clamp members 40 to abut the back side of the retaining ring 16 and secure the frame member 14 in its mounting position with respect to the mounting surface.

The frame member 14 may be installed without the retaining ring 16. More specifically, when the retaining ring 16 is not used, the clamp members 40 engage the back of the mounting surface so as to securely engage the mounting surface between the lip 22 and the respective clamp members 40.

An angled plane 42 (FIG. 2*b*) is defined by the bottom edge of the truncated cylinder 26 forming the body portion 24 and passes through an inwardly extending flange 46 (FIG. 2*a*). The plane 42 forms an included angle $\alpha$ of approximately 7.5 degrees with respect to the plane 44 defined by the inside edge of the lip 22 that abuts the mounting surface when the frame member 14 is mounted to the mounting surface in the desired mounting position.

The flange 46 is formed integrally with the bottom edge of the truncated cylinder 26. The inwardly extending flange 46 is selectively notched to form openings 48 that cooperate with tabs on the baffle 18 to provide for mating of the baffle 18 to the frame member 14 via a bayonet mount. More specifically, the baffle 18 may be mounted to the frame in first and second orientations with respect to the frame 14 as is discussed in greater detail below.

Figure 3A:
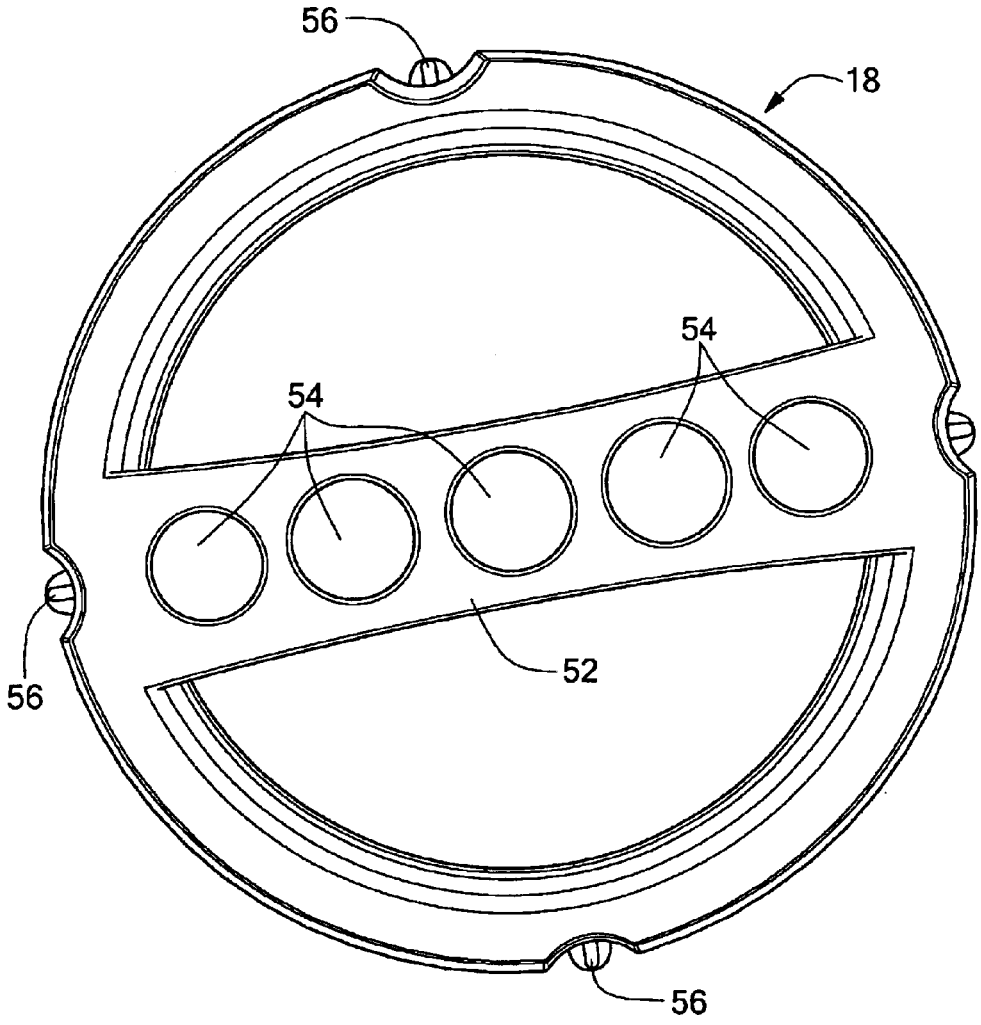
FIG. 3*a* is a front view of a baffle of the type depicted in FIG. 1.
Figure 3B:
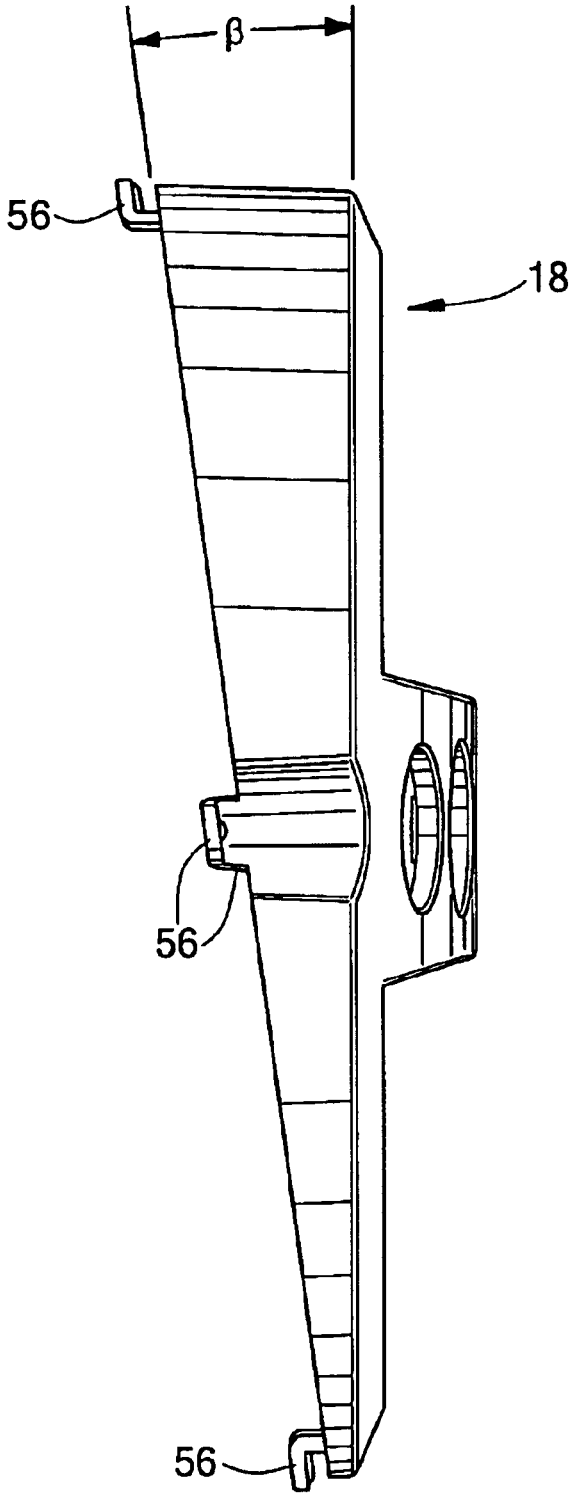
FIG. 3*b* is a side view of the baffle depicted in FIG. 3*a;*
Figure 3C:
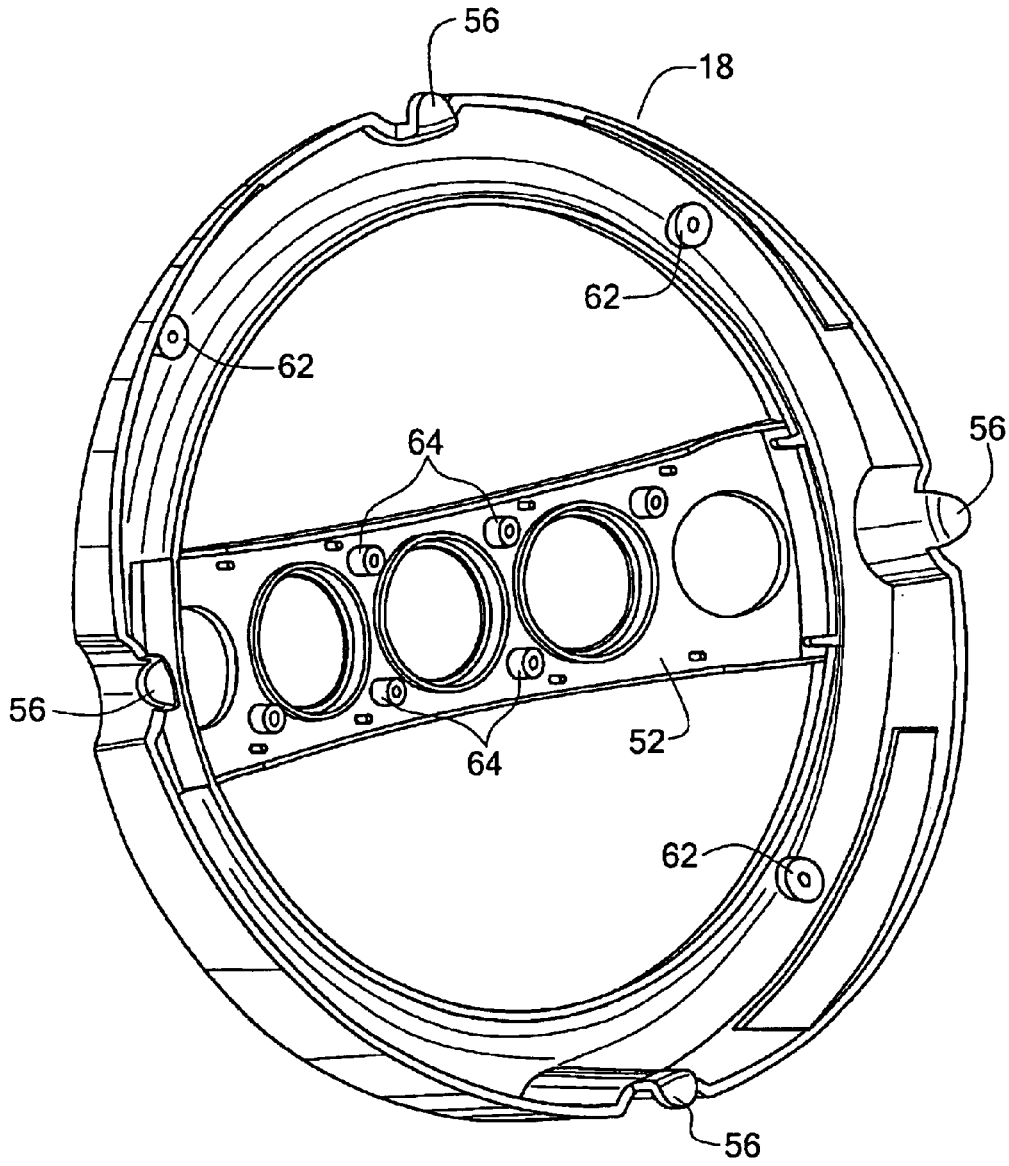
FIG. 3*c* is a rear perspective view of the baffle of FIG. 3*a;*

The baffle 18 is shown with greater particularly in FIGS. 3*a*–3*c*. In the illustrated embodiment, the baffle 18 is generally circular. The baffle 18 includes an outer ring 50 and an integral cross member 52 having a plurality of circular openings 54 therethrough. The baffle 18 has a front edge and a back edge. The back edge of the baffle 18 confronts the flange 46 of the frame member 14 when the baffle 18 is mounted within the frame member 14.

A loudspeaker 12*a* (FIG. 1) is mounted to the baffle 18 via screws that engage openings in standoffs 62 integrally formed on the inner surface of the baffle 18 (FIG. 3*c*). A high frequency speaker 12*b* (FIG. 1) is also mounted to the baffle 18 via screws that engage openings in standoffs 64 that are integrally formed on the inner surface of the cross member 52 of the baffle 18. A crossover printed circuit board 66 (FIG. 1) is mounted to the rear of the loudspeaker 12*a* on standoffs 68 in a conventional manner (FIG. 1).

A plurality of tabs 56 extend from the back edge of the baffle 18 and cooperate with the flange 46 to securely mount the baffle within the frame member 14. More specifically, to mount the baffle 18 within the flange member 14, the baffle 18 is disposed within the flange member 14 with the tabs 56 positioned through the openings 48. The baffle is rotated counterclockwise in the illustrated embodiment to securely mount the baffle 18 to the frame member 14. The tabs 56 and the flange 46 thus form a bayonet mount that allows the mounting of the baffle 18 within the frame member 14.

As illustrated in FIG. 3*b*, the baffle 18 is wedge shaped in side view. The included angle $\beta$ between a plane passing through the inside edge of the baffle 18 and a plane generally passing through the outside edge of the baffle 18 is approximately 7.5 degrees. The baffle 18 may be mounted within the frame member 14 so that the angles $\alpha$ and $\beta$ are additive. Alternatively, the baffle 18 may be mounted within the frame member 14 so that the angles $\alpha$ and $\beta$ offset one another. When the baffle 18 is mounted within the frame member 18 so that the angles $\alpha$ and $\beta$ are additive, the loudspeakers 12*a* and 12*b* are angled such that the centerline for sound projection is oriented at approximately 15 degrees from the mounting surface. When the baffle 18 is mounted within the frame member 18 so that the angles $\alpha$ and $\beta$ are complementary, the loudspeakers 12*a* and 12*b* are angled such that the centerline for sound projection is oriented normal to the mounting surface.

The depth of the truncated cylinder 26 on the frame member 14 is specified such that the baffle 18 does not project beyond the mounting surface. Thus, the perf grille 20 may be mounted to the frame member 14 such that the perf grille is parallel to the mounting surface. In the foregoing manner, a clean appearance for the installed speaker system is achieved while obtaining the desired angle for sound projection.

Typically, when angling the speaker with respect to the wall or ceiling, it is desired to angle the speaker somewhere in the range of 5–25 degrees. Different frame members and/or baffles may be employed, if desired, to achieve different angles. In one embodiment, a two-piece frame and baffle assembly achieves an angle of 15 degrees with respect to the mounting plane. In this configuration, the flange 46 is oriented at an angle of 7.5 degrees with respect to the plane defined by the rear surface of the lip 22. Additionally the frontal plane defined by the frontal edge of the baffle is oriented at a 7.5 degree angle with respect to the plane defined by the rear edge of the baffle.

Figure 4:
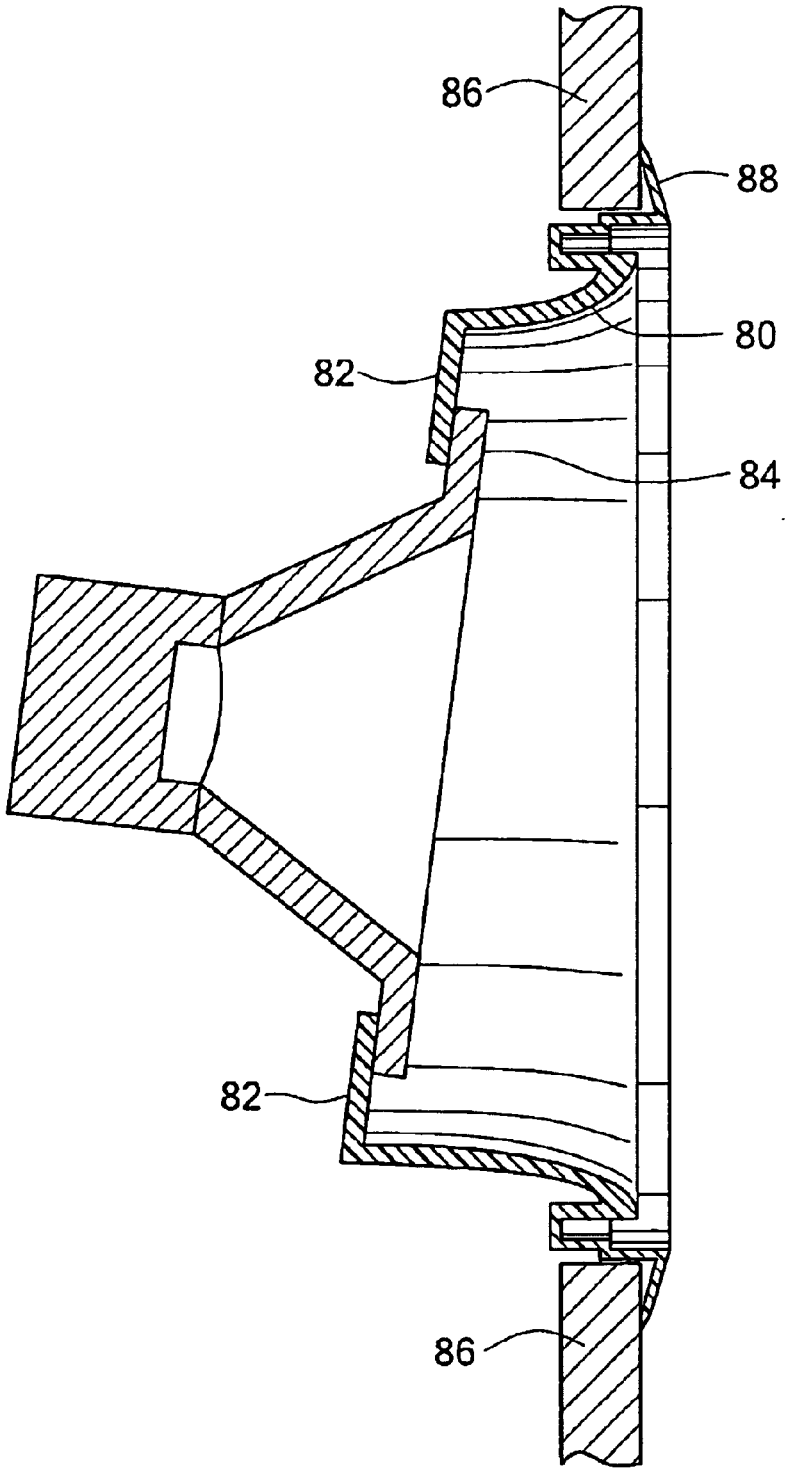
FIG. 4 is a schematic side cross-sectional view of a single piece frame member for flush mounting of a loudspeaker at an angle to and behind a mounting surface in accordance with the present invention.
Figure 5:
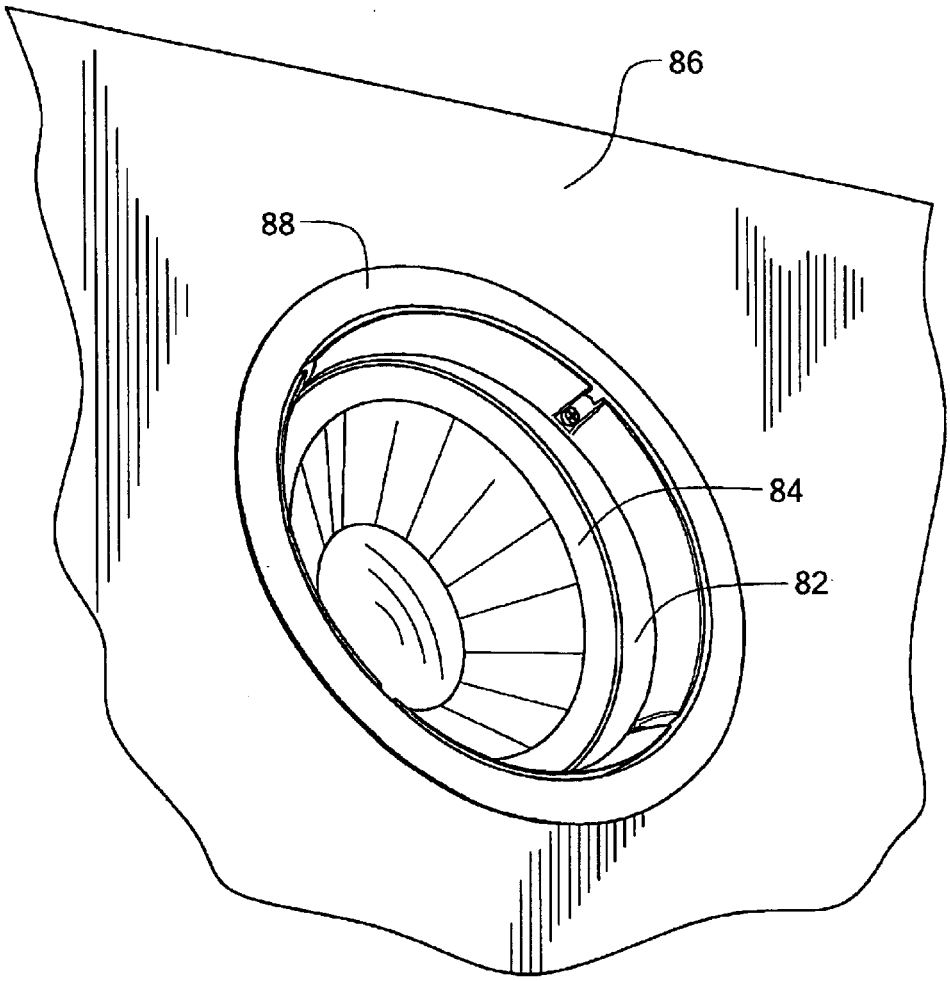
FIG. 5 is a perspective view of the single piece frame member of FIG. 4.

In an alternative embodiment depicted in FIG. 4, the frame member 80 comprises an integrally formed unit. The frame member 80 includes a speaker mounting surface having an opening to allow for the mounting of a speaker 84 so that the speaker 84 is recessed from the ceiling or wall mounting surface 86 when the frame member 80 is mounted within the wall or ceiling. The frame member 80 includes a lip 88 that abuts the mounting surface 86 when the frame member is disposed in its intended mounting position. A grill (not shown) may be mounted to the front edge of the frame member 80 substantially flush with the wall or ceiling 86 to conceal the speaker 84 and create an aesthetically desirable installation. The speaker 84 mounts to the speaker mounting surface 82 from the front of the frame member 80 with the rear portion of the speaker 84 extending through the opening in the speaker mounting surface 82. In preferred embodiment the speaker mounting surface 82 and the speaker mounted thereto are angled 15 degrees from the ceiling or wall mounting surface 86. It should be recognized that any desirable angle may be provided by varying the angle of the speaker mounting surface 82 in the frame member 80 with respect to the wall mounting surface 86. The frame member 80 may be mounted to the mounting surface 86 using the mouunting techniques described above or any other suitable mounting technique for securing the frame member to the mounting surface 86.

The frame member of either the multi-piece frame assembly or the single piece frame may be formed as shown with a generally circular profile. Alternatively, the frame member may have a square, rectangular, or octagonal shape or any other suitable shape. In the case of the multi-piece frame assembly the body opening is configured to receive the baffle as discussed above. It is recognized that the body portion of the frame member need not be cylindrical. More specifically, the body portion must only be sized and configured to provide a body opening that will accommodate the baffle and speaker assembly.

In should be appreciated that other modifications to and variations of the above described loudspeaker mounting systems may be made without departing from the inventive concepts disclosed herein. Accordingly, the invention should not be viewed as limited except by the scope and spirit of the appending claims.

What is claimed is:

1. A loudspeaker mounting assembly for mounting a loudspeaker within an opening in a mounting surface, said mounting assembly comprising:

a frame member having a body portion, said body portion having first and second ends and a lip outwardly extending from one end of said body portion, said lip having a rear surface configured to abut said mounting surface when said frame member is disposed within said opening in a frame member mounting position, said lip rear surface defining a first plane, said body portion having a body opening extending through the body portion, said body opening sized to receive said loudspeaker;

a baffle mountable in said frame member in first and second predetermined orientations, said baffle being configured for mounting said loudspeaker thereto, said baffle including a plurality of speaker mounting surfaces selectively positioned so as to confront selected areas on said loudspeaker when said loudspeaker is mounted to said baffle, said plurality of speaker mounting surfaces defining a loudspeaker mounting plane;

said loudspeaker mounting plane being generally parallel to said first plane when said baffle is mounted within said frame member in said first predetermined orientation, said loudspeaker mounting plane being disposed at a predetermined non-zero angle to said first plane when said baffle is mounted within said frame member in said second predetermined orientation.

2. The mounting assembly of claim 1 wherein said body portion generally comprises a cylinder at least along a portion of the length of said body portion.

3. The mounting assembly of claim 1 wherein said body portion includes a flange inwardly extending into said body opening, said flange oriented generally along a third plane disposed at a first predetermined non-zero angle with respect to said first plane;

said baffle having a frontal surface and a rear edge, said baffle being mounted within said frame member with said rear edge confronting said flange.

4. The mounting assembly of claim 3 wherein said body portion is generally cylindrical along at least a portion of the length of the body portion.

5. The mounting assembly of claim 3 wherein said body portion generally comprises a truncated cylinder having a circular end and a generally elliptical end, said first end of said body portion corresponding to said circular end of said truncated cylinder, and said flange extending inwardly into said body opening along said second end of said truncated cylinder.

6. The mounting assembly of claim 3 wherein said baffle includes a frontal edge located in a baffle frontal plane and a rear edge located in a baffle rear plane and said baffle rear plane is oriented at a second predetermined non-zero angle with respect to said baffle frontal plane, wherein said first predetermined angle is generally the same as said second predetermined angle;

wherein said rear edge of said baffle is positioned in said frame member in said first orientation such that said first and second angles are oriented as opposed included angles such that the frontal plane of said baffle is generally parallel to said first plane, and wherein said rear edge of said baffle is positioned in said frame member in said second orientation such that said first and second angles are additive such that the frontal plane of said baffle is angled at a third predetermined angle with respect to said first plane, wherein said third predetermined angle generally equals the sum of said first and second predetermined angles.

7. The mounting assembly of claim 1 wherein said baffle frontal plane is disposed behind said first plane in both said first and second predetermined baffle mounting orientations.

8. The mounting assembly of claim 7 further including a grill mounted to said frame member, said grill being in a plane generally flush with said first plane.

9. The mounting assembly of claim 1 wherein said frame member and said baffle each include cooperative bayonent mounting structures and said baffle is mountable in said frame member in said first and second predetermined orientations via said respective bayonet mounting structures.

10. The mounting assembly of claim 3 wherein said bayonet mounting structure on said frame member comprises said flange having openings located at predetermined locations on the periphery of said flange and said bayonet mounting structure on said baffle comprises tabs extending from the rear edge of said baffle at predetermined locations on the rear edge of the baffle, said tabs extending through said openings in said flange and said baffle being rotatable with respect to said flange to securely capture said flange between the tabs and the rear edge of said baffle so as to capture said baffle in said frame member in one of said first and second orientations.

11. The mounting assembly of claim 1 further including at least one loudspeaker mounted to said baffle.

12. A loudspeaker mounting assembly for mounting at least one loudspeaker within an opening in a mounting surface, said mounting assembly comprising:

a frame member having a body portion, said body portion having first and second ends and a lip outwardly extending from said first end of said body portion, said lip having a rear surface configured to abut said mounting surface when said frame member is disposed within said opening in a frame member mounting position, said lip rear surface defining a first plane, said body portion having a body opening extending through the body portion, said body opening sized to receive said loudspeaker;

an integrally formed one piece baffle mountable in said body opening of said frame member, said baffle having a front side and a rear side and being configured for mounting at least one loudspeaker thereto, said baffle including a plurality of speaker mounting surfaces selectively positioned so as to confront selected areas on said at least one loudspeaker when said at least one loudspeaker is mounted to said baffle.

13. The loudspeaker mounting assembly of claim 12 wherein said plurality of speaker mounting surfaces are located on said rear side of said baffle.

14. The loudspeaker mounting assembly of claim 12 further including at least one loudspeaker mounted to said baffle.

15. The loudspeaker mounting assembly of claim 14 wherein said at least one loudspeaker comprises a first loudspeaker configured for reproduction of lower range frequences and a second loudspeaker for reproduction of higher range frequences.

16. The loudspeaker mounting assembly of claim 12 wherein said baffle has a rear perimeter having a plurality of tabs extending therefrom and said frame member includes a plurality of flanges inwardly extending from said body portion into said body opening, said baffle being insertable into said body opening of said body portion and rotatable to captively secure said baffle within said opening as a result of the engagement of said plurality tabs with said plurality of flanges.

17. The loudspeaker mounting assembly of claim 16 further including at least one loudspeaker mounted to said baffle.

18. A frame for mounting a loudspeaker within an opening in a generally planar mounting substrate having a first surface facing the interior of a room and a second opposing surface, said frame comprising:

a lip having a substrate confronting surface that confronts the first surface of said mounting substrate when said frame is disposed in said opening in said mounting substrate in a frame mounting position, said substrate confronting surface defining a frame mounting plane;

a speaker mounting surface having an opening therethrough sized to receive a loudspeaker, said speaker mounting surface defining a speaker mounting plane; and a coupling portion extending through said opening in said generally planar mounting substrate when said frame is disposed in said frame mounting position, said coupling portion coupling said lip and said speaker mounting surface, said coupling portion configured such that said speaker mounting surface is disposed on the opposing side of said mounting substrate from said first surface of said mounting substrate when said frame is disposed in said frame mounting position within said opening in said mounting substrate, wherein said speaker mounting plane is angled by a fixed predetermined non-zero angle with respect to said frame mounting plane, wherein said lip, said speaker mounting surface and said coupling portion comprise a single piece structure.

19. The frame of claim 18 wherein said speaker mounting plane is angled with respect to said frame mounting plane by an angle between 5 and 25 degrees.

20. The frame of claim 18 further including a speaker mounted to said speaker mounting surface in a speaker mounting position, said speaker having a rear speaker portion that extends through said opening in said speaker mounting surface when said speaker is mounted to said speaker mounting surface in said speaker mounting position.

* * * * *